US006543219B1

(12) United States Patent
Surnilla

(10) Patent No.: US 6,543,219 B1
(45) Date of Patent: Apr. 8, 2003

(54) ENGINE FUELING CONTROL FOR CATALYST DESULFURIZATION

(75) Inventor: Gopichandra Surnilla, West Bloomfield, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/682,878

(22) Filed: Oct. 29, 2001

(51) Int. Cl.[7] ..... F01N 3/00
(52) U.S. Cl. ..... 60/285; 60/274; 60/295
(58) Field of Search ..... 60/274, 285, 295, 60/299, 276, 301; 123/443

(56) References Cited

U.S. PATENT DOCUMENTS

| | | | | |
|---|---|---|---|---|
| 4,006,722 A | | 2/1977 | Hata et al. | |
| 4,051,816 A | | 10/1977 | Masaki | |
| 4,056,931 A | | 11/1977 | Hata | |
| 4,068,473 A | | 1/1978 | Masaki | |
| 4,089,310 A | | 5/1978 | Noguchi et al. | |
| 4,227,496 A | | 10/1980 | Martel | |
| 5,074,113 A | * | 12/1991 | Matsuoka | 60/276 |
| 5,377,654 A | | 1/1995 | LoRusso et al. | |
| 5,450,837 A | * | 9/1995 | Uchikawa | 60/285 |
| 5,570,574 A | | 11/1996 | Yamashita et al. | |
| 5,657,625 A | | 8/1997 | Koga et al. | |
| 5,661,971 A | | 9/1997 | Waschatz et al. | |
| 5,894,726 A | | 4/1999 | Monnier | |
| 5,954,034 A | | 9/1999 | Takagi | |
| 5,974,793 A | | 11/1999 | Kinugasa et al. | |
| 5,983,627 A | | 11/1999 | Asik | |
| 6,012,428 A | | 1/2000 | Yano et al. | |
| 6,014,859 A | | 1/2000 | Yoshizaki et al. | |
| 6,122,910 A | * | 9/2000 | Hoshi et al. | 60/285 |
| 6,151,890 A | * | 11/2000 | Hoshi | 60/285 |
| 6,186,131 B1 | | 2/2001 | Mitsutani et al. | |
| 6,205,773 B1 | | 3/2001 | Suzuki | |
| 6,237,330 B1 | * | 5/2001 | Takahashi et al. | 60/285 |
| 6,250,074 B1 | * | 6/2001 | Suzuki et al. | 123/443 |
| 6,324,835 B1 | * | 12/2001 | Surnilla et al. | 60/285 |

* cited by examiner

*Primary Examiner*—Thomas Denion
*Assistant Examiner*—Diem Tran
(74) *Attorney, Agent, or Firm*—Allan J. Lippa; John D. Russell

(57) ABSTRACT

A method is described for controlling decontamination of an emission control device. Temperature of the emission control device is maintained at a desired temperature by operating some cylinders of the engine lean and others rich. These lean and rich mixtures react exothermically in the exhaust gas and in the emission control device to generate heat. Efficient contaminant removal is obtained by oscillating the mixture air-fuel ratio about stoichiometry. This oscillation is provided by adjusting the fuel provided to the rich cylinders, or by adjusting the air provided to the lean cylinders, thereby minimizing any torque disturbance corresponding to the oscillations in exhaust air-fuel ratio.

25 Claims, 5 Drawing Sheets

ENGINE FUELING CONTROL FOR CATALYST DESULFURIZATION

BACKGROUND OF THE INVENTION

The field of the invention relates to engine air-fuel ratio control during catalyst desulfurization, and more particularly to operating some cylinder groups lean and others rich.

Engines can increase exhaust component temperatures by operating with some cylinders at a lean air-fuel ratio and other cylinders at a rich air-fuel ratio. When the gas streams of lean and rich gasses meet in the exhaust system and mix, an exothermic reaction occurs to generate heat. This reaction can be improved by having a catalyst in the exhaust. The mixture air-fuel ratio can be maintained at the stoichiometric ratio by providing feedback air-fuel ratio control based on a sensor in the exhaust manifold, which is upstream of the catalyst as shown in U.S. Pat. No. 4,089,310.

The inventors herein have recognized a disadvantage with the above approach. In particular, when trying to de-sulfate the catalyst, the oscillation of the overall exhaust air-fuel ratio may be insufficient. In particular, since the feedback from the exhaust manifold sensor causes oscillations based on the ratio of the mixture upstream the catalyst, control of the oscillations is performed irrespective of the conditions in the catalyst or the conditions downstream of the catalyst. Further still, if there are multiple catalysts in the exhaust system, control of the oscillations based on an exhaust manifold sensor may provide no oscillations in the air-fuel mixture entering catalyst downstream of the first catalyst (due to the filtering effect of the first catalyst on the exhaust air-fuel ratio). As such, downstream catalysts that need to be decontaminated, may received exhaust air-fuel mixtures without sufficient oscillations to effectively remove sulfur, or other contaminants.

The inventors herein have also recognized a disadvantage with DE 199,23,481. Using the system of this reference, the oscillation of the exhaust gas mixture can be provided by adjusting either the fuel injection amount or the air amount to all of the cylinders based on a sensor located downstream of the catalyst. However, in either case, adjustment in this way may not maintain the catalyst temperature at a necessary decontamination temperature. In other words, when operating all of the cylinders around stoichiometry, exhaust gas temperature may fall too low and decontamination can become inefficient since there is little to no exothermic reaction (i.e., all cylinders are either lean or rich).

SUMMARY OF INVENTION

Disadvantages with prior approaches are overcome by a method for controlling an engine having a first and second group of cylinders, both of which are coupled to an emission control device. The method comprises operating the first group on average at a first lean air-fuel ratio; operating the second group at a second air-fuel ratio; and adjusting said second air-fuel ratio based on a condition in or downstream of the emission control device by controlling fuel injected into the second group to cause a mixture air-fuel ratio of a mixture of gasses from the first and second group to oscillate around a predetermined air-fuel ratio.

By adjusting the second air-fuel ratio via fuel injected into the second group to cause a mixture air-fuel ratio of a mixture of gasses from the first and second group to oscillate around a predetermined air-fuel ratio, it is possible to minimize cylinder torque oscillations. Further, by taking into account either the conditions in or downstream of the catalyst, more efficient sulfur removal is possible.

Note that the result is that the fuel to the rich cylinders is adjusted differently than the fuel to the lean cylinders so that a mixture air-fuel ratio oscillates with minimal torque imbalance. The difference in adjustment may be an adjustment only to the rich cylinders based on the downstream sensor so that the mixture oscillates about stoichiometry, or both may be adjusted, but a larger adjustment is made to the rich bank. Any remaining torque imbalance can be handled by spark retard on the rich cylinder, if desired.

In an alternate embodiment, air added to the lean cylinder group is primarily adjusted to oscillate the mixture air-fuel ratio.

DETAILED DESCRIPTION

Figure 1A:
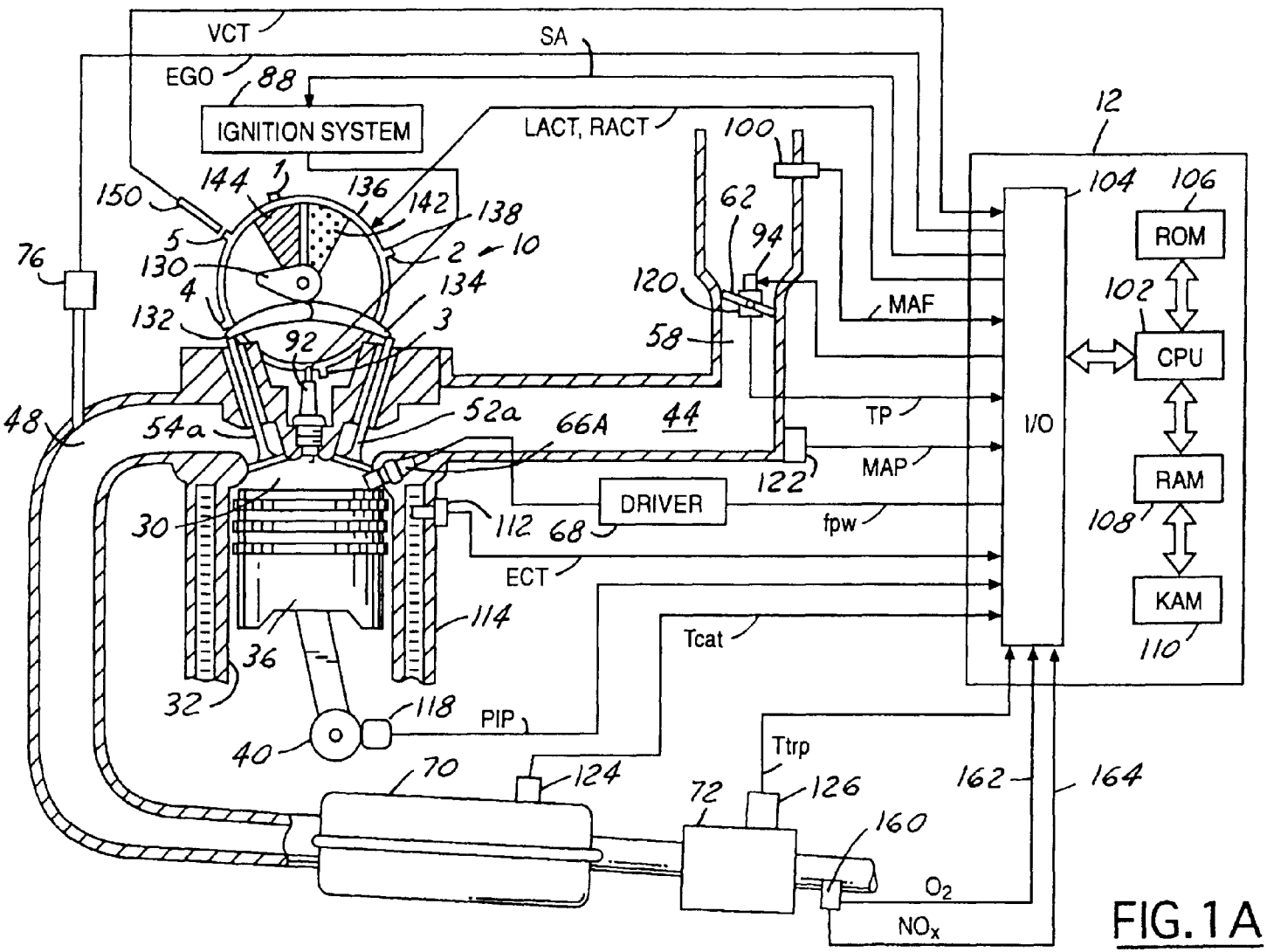
FIGS. 1A and 1B are a block diagrams of an embodiment in which the invention is used to advantage.

Direct injection spark ignited internal combustion engine 10, comprising a plurality of combustion chambers, is controlled by electronic engine controller 12. Combustion chamber 30 of engine 10 is shown in FIG. 1A including combustion chamber walls 32 with piston 36 positioned therein and connected to crankshaft 40. In this particular example, piston 36 includes a recess or bowl (not shown) to help in forming stratified charges of air and fuel. Combustion chamber, or cylinder, 30 is shown communicating with intake manifold 44 and exhaust manifold 48 via respective intake valves 52*a* and 52*b* (not shown), and exhaust valves 54*a* and 54*b* (not shown). Fuel injector 66A is shown directly coupled to combustion chamber 30 for delivering liquid fuel directly therein in proportion to the pulse width of signal fpw received from controller 12 via conventional electronic driver 68. Fuel is delivered to fuel injector 66A by a conventional high pressure fuel system (not shown) including a fuel tank, fuel pumps, and a fuel rail.

Intake manifold 44 is shown communicating with throttle body 58 via throttle plate 62. In this particular example, throttle plate 62 is coupled to electric motor 94 so that the position of throttle plate 62 is controlled by controller 12 via electric motor 94. This configuration is commonly referred to as electronic throttle control (ETC), which is also utilized during idle speed control. In an alternative embodiment (not shown), which is well known to those skilled in the art, a bypass air passageway is arranged in parallel with throttle plate 62 to control inducted airflow during idle speed control via a throttle control valve positioned within the air passageway.

Exhaust gas oxygen sensor 76 is shown coupled to exhaust manifold 48 upstream of catalytic converter 70. In this particular example, sensor 76 provides signal EGO to controller 12 which converts signal EGO into two-state signal EGOS. A high voltage state of signal EGOS indicates exhaust gases are rich of stoichiometry, and a low voltage state of signal EGOS indicates exhaust gases are lean of stoichiometry. Signal EGOS is used to advantage during feedback air/fuel control in a conventional manner to maintain average air/fuel at stoichiometry during the stoichiometric homogeneous mode of operation.

Conventional distributorless ignition system 88 provides ignition spark to combustion chamber 30 via spark plug 92 in response to spark advance signal SA from controller 12.

Controller 12 causes combustion chamber 30 to operate in either a homogeneous air/fuel mode or a stratified air/fuel mode by controlling injection timing. In the stratified mode, controller 12 activates fuel injector 66A during the engine compression stroke so that fuel is sprayed directly into the bowl of piston 36. Stratified air/fuel layers are thereby formed. The strata closest to the spark plug contain a stoichiometric mixture or a mixture slightly rich of stoichiometry, and subsequent strata contain progressively leaner mixtures. During the homogeneous mode, controller 12 activates fuel injector 66A during the intake stroke so that a substantially homogeneous air/fuel mixture is formed when ignition power is supplied to spark plug 92 by ignition system 88. Controller 12 controls the amount of fuel delivered by fuel injector 66A so that the homogeneous air/fuel mixture in chamber 30 can be selected to be at stoichiometry, a value rich of stoichiometry, or a value lean of stoichiometry. The stratified air/fuel mixture will always be at a value lean of stoichiometry, the exact air/fuel being a function of the amount of fuel delivered to combustion chamber 30. An additional split mode of operation wherein additional fuel is injected during the exhaust stroke while operating in the stratified mode is also possible.

Nitrogen oxide (NOx) absorbent or trap 72 is shown positioned downstream of catalytic converter 70. NOx trap 72 absorbs NOx when engine 10 is operating lean of stoichiometry. The absorbed NOx is subsequently reacted with HC and CO and catalyzed during a NOx purge cycle when controller 12 causes engine 10 to operate in either a rich homogeneous mode or a near stoichiometric homogeneous mode.

Controller 12 is shown in FIG. 1A as a conventional microcomputer including: microprocessor unit 102, input/output ports 104, an electronic storage medium for executable programs and calibration values shown as read-only memory chip 106 in this particular example, random access memory 108, keep-alive memory 110, and a conventional data bus. Controller 12 is shown receiving various signals from sensors coupled to engine 10, in addition to those signals previously discussed, including: measurement of inducted mass air flow (MAF) from mass air flow sensor 100 coupled to throttle body 58; engine coolant temperature (ECT) from temperature sensor 112 coupled to cooling sleeve 114; a profile ignition pickup signal (PIP) from Hall effect sensor 118 coupled to crankshaft 40; throttle position TP from throttle position sensor 120; and absolute Manifold Pressure Signal MAP from sensor 122. Engine speed signal RPM is generated by controller 12 from signal PIP in a conventional manner and manifold pressure signal MAP from a manifold pressure sensor provides an indication of vacuum, or pressure, in the intake manifold. During stoichiometric operation, this sensor can give an indication of engine load. Further, this sensor, along with engine speed, can provide an estimate of charge (including air) inducted into the cylinder.

In a preferred aspect of the present invention, sensor 118, which is also used as an engine speed sensor, produces a predetermined number of equally spaced pulses every revolution of the crankshaft.

In this particular example, temperature Tcat of catalytic converter 70 and temperature Ttrp of NOx trap 72 are inferred from engine operation, as disclosed in U.S. Pat. No. 5,414,994, the specification of which is incorporated herein by reference. In an alternate embodiment, temperature Tcat is provided by temperature sensor 124 and temperature Ttrp is provided by temperature sensor 126.

Continuing with FIG. 1A, camshaft 130 of engine 10 is shown communicating with rocker arms 132 and 134 for actuating intake valves 52*a*, 52*b* and exhaust valve 54*a*, 54*b*. Camshaft 130 is directly coupled to housing 136. Housing 136 forms a toothed wheel having a plurality of teeth 138. Housing 136 is hydraulically coupled to an inner shaft (not shown), which is in turn directly linked to camshaft 130 via a timing chain (not shown). Therefore, housing 136 and camshaft 130 rotate at a speed substantially equivalent to the inner camshaft. The inner camshaft rotates at a constant speed ratio to crankshaft 40. However, by manipulation of the hydraulic coupling, as will be described later herein, the relative position of camshaft 130 to crankshaft 40 can be varied by hydraulic pressures in advance chamber 142 and retard chamber 144. By allowing high pressure hydraulic fluid to enter advance chamber 142, the relative relationship between camshaft 130 and crankshaft 40 is advanced. Thus, intake valves 52*a*, 52*b*, and exhaust valves 54*a*, 54*b* open and close at a time earlier than normal relative to crankshaft 40.

Similarly, by allowing high pressure hydraulic fluid to enter retard chamber 144, the relative relationship between camshaft 130 and crankshaft 40 is retarded. Thus, intake valves 52*a*, 52*b* and exhaust valves 54*a*, 54*b* open and close at a time later than normal relative to crankshaft 40.

Teeth 138, being coupled to housing 136 and camshaft 130, allow for measurement of relative cam position via cam timing sensor 150 providing signal VCT to controller 12. Teeth 1, 2, 3, and 4 are preferably used for measurement of cam timing and are equally spaced (for example, in a V-8 dual bank engine, spaced 90° apart from one another), while tooth 5 is preferably used for cylinder identification, as described later herein. In addition, Controller 12 sends control signals (LACT,RACT) to conventional solenoid valves (not shown) to control the flow of hydraulic fluid either into advance chamber 142, retard chamber 144, or neither.

Relative cam timing is measured using the method described in U.S. Pat. No. 5,548,995, which is incorporated herein by reference. In general terms, the time or rotation angle between the rising edge of the PIP signal and receiving a signal from one of the plurality of teeth 138 on housing 136 gives a measure of the relative cam timing. For the particular example of a V-8 engine, with two cylinder banks and a five-toothed wheel, a measure of cam timing for a particular bank is received four times per revolution, with the extra signal used for cylinder identification.

Sensor 160 provides an indication of both oxygen concentration in the exhaust gas as well as NOx concentration. Signal 162 provides controller a voltage indicative of the O2 concentration, while signal 164 provides a voltage indicative of NOx concentration.

Note that FIG. 1A (and also 1B) merely shows one cylinder of a multi-cylinder engine, and that each cylinder has its own set of intake/exhaust valves, fuel injectors, spark plugs, etc. Thus, each cylinder may have a separate variable cam timing (or lift) actuator, or each bank may have a separate unit, or all cylinders may be operated via a common variable cam timing/lift actuator.

Figure 1B:
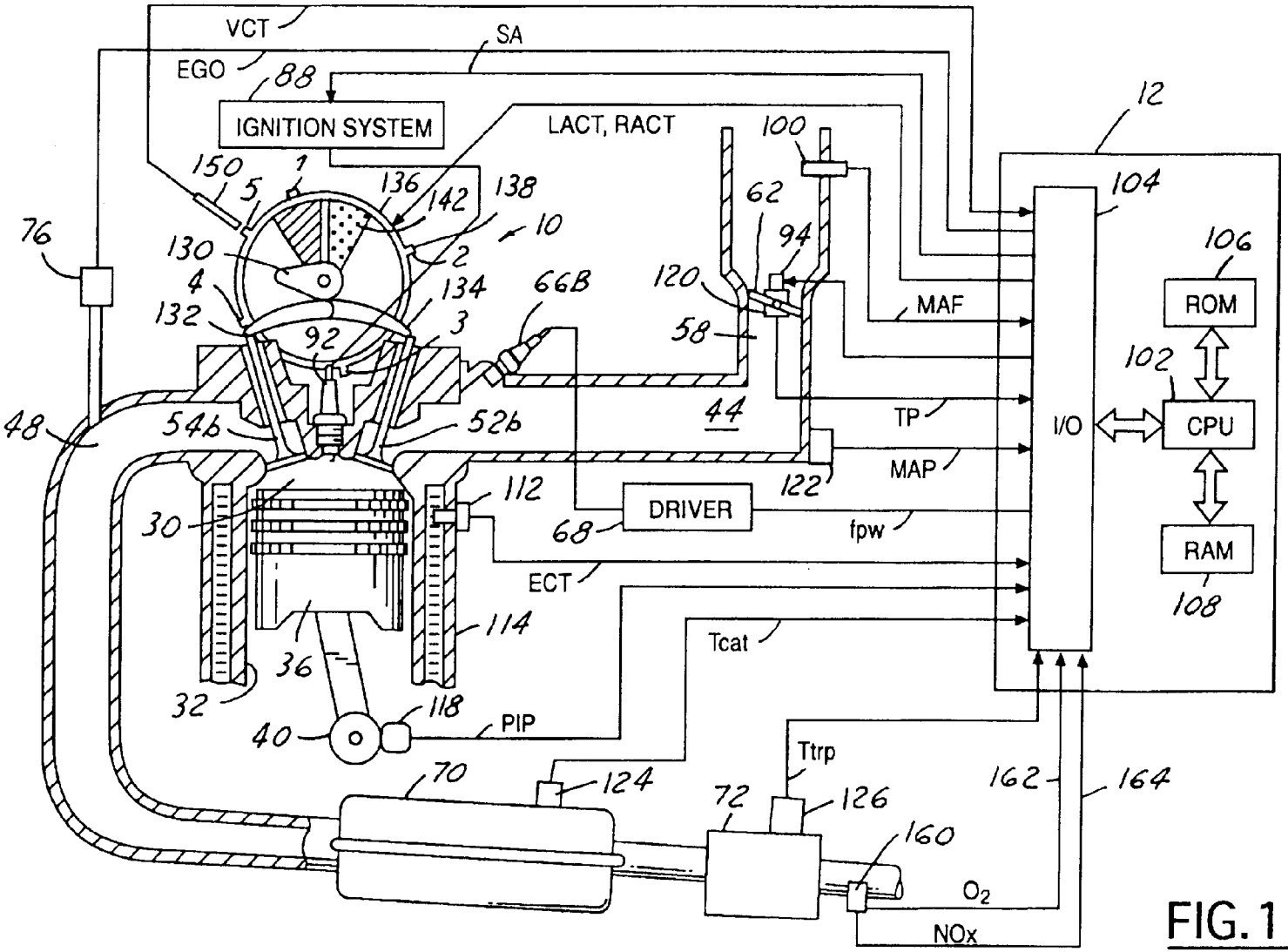

Referring now to FIG. 1B, a port fuel injection configuration is shown where fuel injector 66B is coupled to intake manifold 44, rather than directly cylinder 30. The engine 10 operates in various modes, including lean operation, rich operation, and "near stoichiometric" operation. "Near stoichiometric" operation refers to oscillatory operation around the stoichiometric air fuel ratio. Typically, this oscillatory operation is governed by feedback from exhaust gas oxygen sensors. In this near stoichiometric operating mode, the engine is operated within one air fuel ratio of the stoichiometric air fuel ratio.

As described above, feedback air-fuel ratio control is used for providing the near stoichiometric operation. Further, feedback from exhaust gas oxygen sensors can be used for controlling air-fuel ratio during lean and during rich operation. In particular, a switching type HEGO sensor can be used for stoichiometric air-fuel ratio control by controlling fuel injected (or additional air via throttle or VCT) based on feedback from the HEGO sensor and the desired air-fuel ratio. Further, a UEGO sensor (which provides a substantially linear output versus exhaust air-fuel ratio) can be used for controlling air-fuel ratio during lean, rich, and stoichiometric operation. In this case, fuel injection (or additional air via throttle or VCT) is adjusted based on a desired air-fuel ratio and the air-fuel ratio from the sensor.

Figure 2:
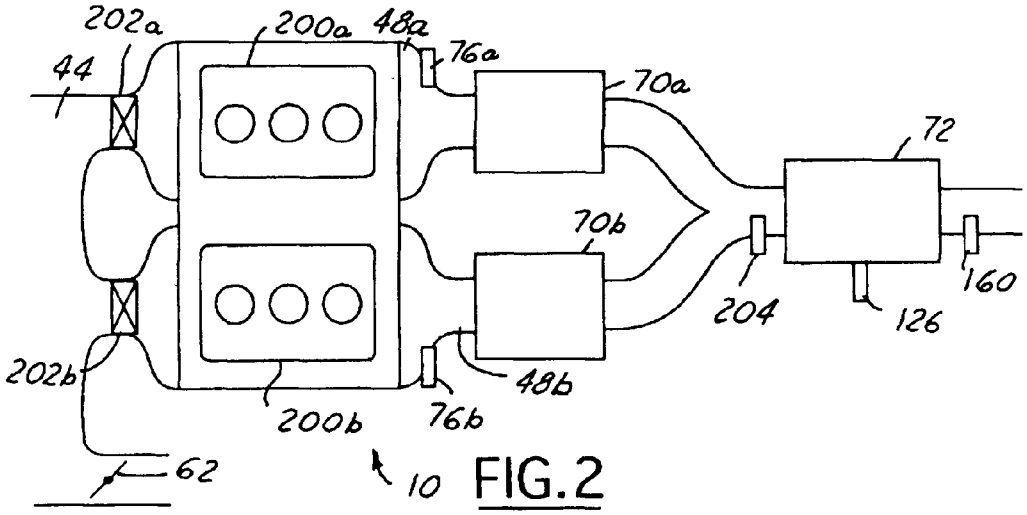
FIG. 2 is a block diagram of an embodiment in which the invention is used to advantage.

Also note that various methods can be used according to the present invention to maintain the desired torque such as, for example, adjusting ignition timing, throttle position, variable cam timing position, and exhaust gas recirculation amount. Further, these variables can be individually adjusted for each cylinder to maintain cylinder balance among all the cylinder groups. For example, if the rich cylinder group is producing slightly more torque than the lean cylinder group, then the ignition timing of the rich cylinder group can be adjusted away from best torque timing (e.g., retarded). Alternatively, if the lean cylinder group is producing slightly more torque than the rich cylinder group, then the ignition timing of the lean cylinder group can be adjusted away from best torque timing (e.g., retarded)Referring now to FIG. 2, engine 10 is shown having first and second cylinder groups 200A and 200B. In this particular example, the first and second cylinder groups are shown having equal amounts of three cylinders. However, the cylinder groups can have differing numbers of cylinders as well as only a single cylinder. The first cylinder group is shown coupled to a first exhaust manifold portion 48B while second cylinder group is shown coupled to a second exhaust manifold portion 488.

The first cylinder group 200A is shown coupled to a first emission control device 70A and a first exhaust gas oxygen (air-fuel ratio sensor) 76A. Similarly, second cylinder group is coupled to exhaust gas sensor 76B. The exhaust gases exiting catalysts 70A and 70B are joined to form a mixture exhaust gas, which enters catalyst 72. Exhaust air-fuel ratio upstream and downstream of catalyst 72 is measured via sensors 204 and 160, respectively. Also, temperature of downstream catalyst 72 is measured via temperature sensor 126 or may be estimated based on operating conditions. An air-fuel ratio mixture enters the first cylinder group 200A via outlet control device 202A. Outlet control device 202A can be, for example, variable cam timing system as described above herein. Similarly, a mixture air-fuel ratio enters the second cylinder group via outlet control device 202B. Also, first and second sets of fuel injectors are coupled to the first and second cylinder groups, respectively (not shown). Air enters manifold 44 via throttle 62. Note that various other outlet control devices can be used such as, for example, variable valve lift, electrically actuated valves (camless), or others.

Figure 3:
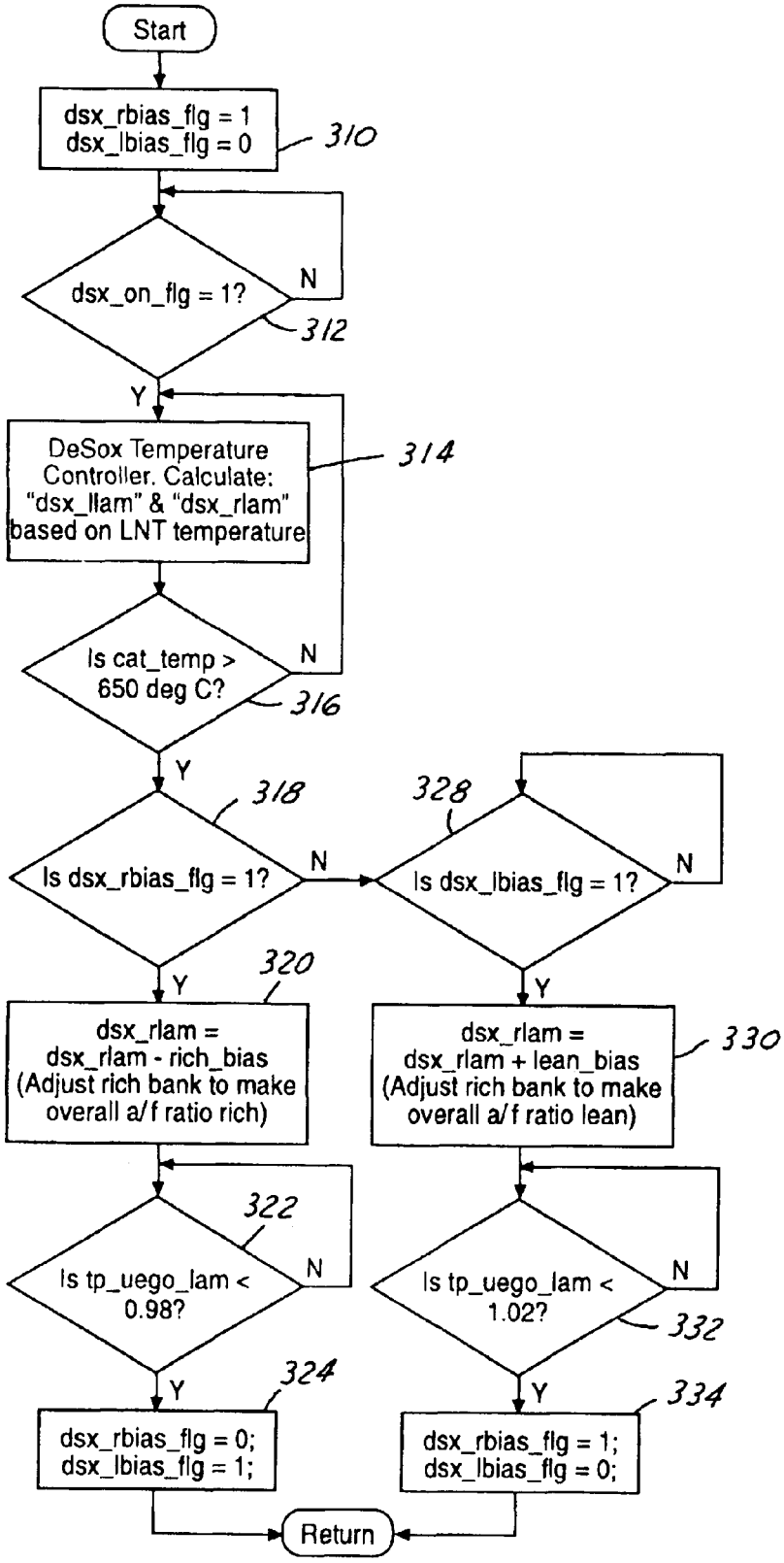
FIGS. 3–4 are high level flowcharts which perform a portion of operation of the embodiment shown in FIGS. 1A, 1B, and 2.

Referring now to FIG. 3, a routine is described for controlling air-fuel ratio of a first and second cylinder group to remove sulfur from the catalyst. First, in step 310, rich bias flag (DSX_RBIAS_FLG) is set to 1 and lean bias flag (DSX_LBIAS_FLG) is set to 0. The rich and lean bias flags are used to bias the overall exhaust gas mixture air-fuel ratio. In other words, the rich bias flag is used to bias the overall mixture of gasses from the first and second cylinder groups to have an overall rich exhaust air-fuel ratio. Similarly, the lean bias flag is used to bias the overall exhaust air-fuel mixture lean stoichiometry.

As described below herein, this biasing of the overall exhaust mixture between a lean and rich bias is accomplished, for example, by adjusting the air-fuel ratio of a cylinder group operating rich. Also, in one example, feedback from an exhaust gas sensor located downstream of the catalyst to be decontaminated (i.e., desulfated) is used to control the oscillations to remove sulfur throughout the entire device.

Next, in step 312, a determination is made as to whether DE-SOX operation is appropriate by determining whether DE-SOX flag (DSX_ON_FLG) is set to 1. This flag is set to 1 when conditions are appropriate for entry into the desulfurization routine. For example, these conditions can be based on any one or combination of the following: vehicle speed, engine speed, exhaust temperature, amount of sulfur deposited on the catalyst, efficiency of the catalyst, storage capacity of catalyst, reaction efficiency of the catalyst, or various other conditions. When the answer to step 312 is no, the routine repeats this determination.

When the answer to step 312 is yes, the routine continues to step In step 314, the engine is controlled to increase temperature of the catalyst. In particular, in one example, the first cylinder group is operated with a rich combustion air-fuel ratio and a second cylinder group is operated with a lean cylinder combustion air-fuel ratio. In this way, reductants are provided to the exhaust path via the rich cylinder group and oxidants are provided to the exhaust path via the lean cylinder group. These additional reductants and oxidants react exothermically in the exhaust and on the catalyst to generate heat. This heat increases temperature of the catalyst.

The inventors herein recognize that there are various other methods for increasing catalyst temperature such as, for example: retarding ignition timing, modulating overall exhaust air-fuel ratio between lean and rich, late injection and indirect injection engine, and various others. Also, the degree of leanness in the second cylinder group and the degree of richness in the first cylinder group can be adjusted based on a measured or estimated catalyst temperature. In particular, the difference between the lean cylinder group and the rich cylinder group can be increased to generate more heat in response to a catalyst temperature below a desired temperature. Alternatively, the difference between the lean cylinder group and the rich cylinder group can be decreased to generate less heat in response to catalyst temperature greater than the desired catalyst temperature.

In step 316 a determination is made as to whether catalyst temperature (CAT_TEMP) is greater than a predetermined threshold temperature. In this particular example, the predetermined threshold temperature is 650° C. However, various other temperature values can be used depending on the catalyst's composition, structure and materials. When the answer to step 316 is no, the routine returns to step 314. Otherwise, when the answer to step 316 is yes, the routine continues to step 318.

In step 318, a determination is made as to whether the rich bias flag is set equal to 1. When the answer to step 318 is yes, this indicates that the overall exhaust air-fuel mixture of the first and second cylinder groups should be biased on the rich side of stoichiometry. Otherwise, routine continues to step 328 described later herein.

When the answer to step 318 is yes, the routine continues to step 320 where the desired rich air-fuel ratio (DSX_RALM) is determined. In this particular example, the desired rich air-fuel ratio for the rich cylinder group is set equal to the desired rich air-fuel ratio to maintain catalyst temperature determined in step 314 minus the rich bias (rich_bias). The actual cylinder air-fuel ratio is adjusted so that it approaches the desired rich cylinder air-fuel ratio based on an open loop estimate of air entering the cylinder (determined based on manifold pressure and engine speed or mass air flow) and feedback from exhaust gas oxygen sensors coupled to the engine exhaust.

Then, in step of 322, a determination is made as to whether exhaust air-fuel ratio exiting the catalyst is less than a predetermined threshold. In this particular example, a determination is made as to whether the output from the universal exhaust gas oxygen sensor couple downstream of the catalyst 72 (TP_UEGO_LAM) is less than 0.98 air-fuel ratios. Thus, a determination is made as to whether the air-fuel ratio in the tailpipe is richer than a predetermined value. When the answer to step 322 is no, the routine continues to monitor this downstream sensor while maintaining the overall exhaust air-fuel mixture of the first and second cylinder groups with a rich bias, wherein the first cylinder group is operated with a rich air fuel ratio and the second cylinder group is operated with a lean air-fuel ratio, wherein the rich bias is provided by adjusting (or modulating) the first cylinder group operating rich. When the answer to step 322 is no, this indicates that the overall mixture air-fuel ratio bias should no longer be continued rich, but rather should be set to a lean value. Thus, instead of 324, the rich bias flag is set to 0 and the lean bias flag is set to 1 to indicate that the engine should operate the first and second cylinder groups such that the overall exhaust air-fuel ratio is biased lean of stoichiometry.

As will be described below herein, this change of the overall exhaust air-fuel mixture from rich to lean is accomplished by adjusting the rich air-fuel ratio of the first cylinder group, thereby minimizing any abrupt change in torque due to this transition, as well as any torque imbalance between the cylinder groups.

Continuing with FIG. 3, when the answer to step 318 is no, the routine continues to step 328. In step 328, a determination is made as to whether the lean bias flag has been set to 1. When the answer to step 328 is no, the routine repeats this determination. Otherwise, when the answer to step 328 is yes, the routine continues to step 330. In step 330, the desired rich air-fuel ratio for the first cylinder group is determined based on the desired rich cylinder air-fuel ratio to maintain catalyst temperature plus a lean bias (LEAN_BIAS). In this example, the fuel provided to the cylinder group is adjusted based on feedback from an exhaust gas oxygen sensor coupled to the exhaust system as well as based on open loop estimates to ensure that the actual cylinder air-fuel ratio approaches the desired cylinder air-fuel ratio.

Also note that similar open loop and closed loop feedback control is provided to maintain the desired lean cylinder air-fuel ratio in the second cylinder group.

Next, in step 332, a determination is made as to whether the air-fuel ratio exiting the catalyst is leaner than a predetermined value. In this particular example, a determination is made as to whether the relative air-fuel ratio is less than 1.02. The inventors herein recognize that various other thresholds or methods for determining whether to end either the rich or lean overall exhaust air-fuel bias are available such as, for example, using output of an exhaust gas oxygen sensor that switches between lean and rich. When the answer to step 332 is yes, the overall lean air-fuel ratio bias is ended and the flags are set to again provide the overall rich bias in step 334.

In this way, the engine is operated to adjust the rich air-fuel ratio in a first cylinder group (while the other cylinder group operates lean of stoichiometry) to provide the exhaust mixture of the first and second cylinder group with an oscillating air-fuel ratio bias above and below (lean and rich) of stoichiometry. This oscillating control is continued until the routine no longer desires to remove sulfur contamination from the catalyst. At this time, normal cylinder air-fuel operation is provided.

Note, in the example described above, the rich cylinder air-fuel ratio is adjusted based on a condition of the exhaust gas composition downstream of the emission control device. However, the inventors herein recognize that the condition downstream of the catalyst can be determined in various other ways. For example, the exhaust gas composition downstream of the catalyst can be estimated based on operating conditions and by making assumptions about the reactions occurring in the catalyst. Further, a catalyst model can be used. For example, inventors herein have assumed that the following reaction equations govern the removal of sulfur at elevated catalyst temperatures.

$$CeO+O_2 \rightarrow Ce_2O_3 \quad \text{(Lean)}$$

$$BaSO_4+H_2 \rightarrow H_2S+BaO$$

$$Ce_2O_3+H_2S \rightarrow SO_2+H_2O+CeO \quad \text{(Rich)}$$

Thus, in an alternative embodiment, conditions in or downstream of the catalyst can be estimated based on engine operating conditions (such as, for example, engine airflow, temperature, air-fuel ratio, time, catalyst composition, catalyst temperature, exhaust air-fuel ratio upstream and downstream of the catalyst, and others). This estimation can further be based on the above assumptions regarding the chemical reactions in the catalyst.

Also, the above chemical assumptions illustrate why it is important, but not essential, to consider conditions downstream of the catalyst. In particular, if the sulfur contamination is located near the exit of the catalyst, this sulfur may not be efficiently removed unless the conditions near the site of contamination are changed between lean and rich. As such, by considering the conditions downstream of the catalyst, one can maximized the possibility of sulfur removal, even for sulfur located near the exit of the catalyst. This is because the sensor downstream does not indicate a lean (or rich) value until the entire catalyst has been equilibrated to an oxidizing (or reducing) atmosphere.

Further, the above example illustrates how fuel injected into the rich cylinder group was adjusted to oscillate the mixture air-fuel ratio, with one group operating rich and the other operating lean. Such an approach is especially advantageous when a single throttle controls airflow entering both cylinder groups. However, if each cylinder group is coupled with a variable cam timing/lift actuator (as described in FIGS. 1A, 1B, and 2), then an alternative approach can be used.

In this alternative approach, the mixture oscillation about stoichiometry can be provided by adjusting excess air added to the lean cylinder group. In other words, rather than adjusting fuel injected into the rich cylinder group differently than fuel injected into the lean cylinder group, excess air added to the lean cylinder group can be adjusted differently than air added to the rich cylinder group. This can be done even when a single throttle is present by controlling the variable cam/lift timing actuator on the lean group differently than that of the rich cylinder group. As such, this additional air can be adjusted based on feedback from the sensor downstream of the catalyst to be decontaminated.

Figure 4:
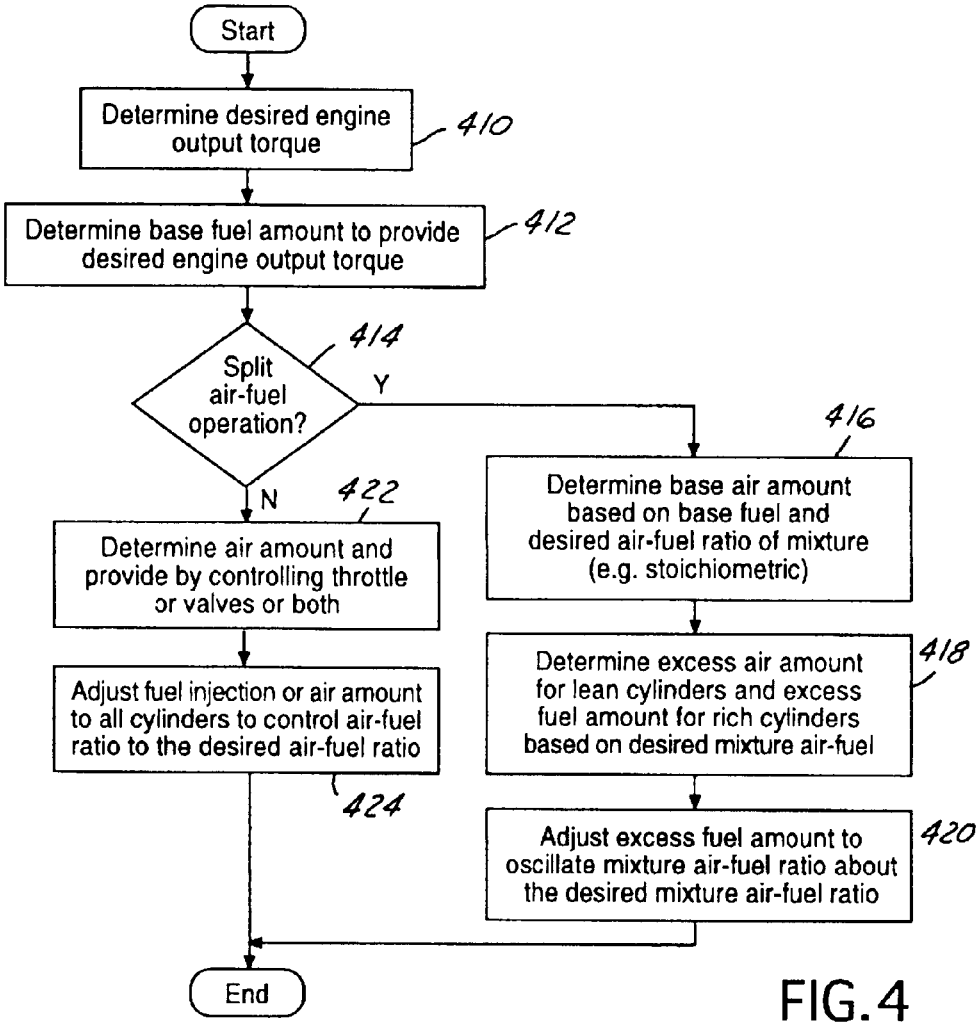

Referring now to FIG. 4, a routine is described for controlling engine output torque according to the present invention. First, in step 410, the routine determines a desired engine output torque. The desired engine torque can be determined in a variety of ways, including: based on pedal position and vehicle speed, based on a desired wheel torque and a gear ratio from the engine to the wheels, based on a desired cruise control requested torque (wherein the desired cruise control torque is based on a difference between a desired vehicle speed and a measured vehicle speed using, for example, a proportional integral controller), based on a traction control torque request (the traction control torque request can be based on a necessary torque reduction for eliminating and/or preventing wheel slip), desired torque to allow a smooth gear shift based on transmission speeds and clutch pressures, or various other methods.

Next, in step 412, a base fuel amount is determined to provide the desired engine output torque. Then, in step 414, a determination is made as to whether split air-fuel operation is required. In particular, this determination is made by evaluating whether high catalyst temperatures are required to remove contaminants on the emission control device. When the answer to step 414 is yes, the routine continues to step 416.

In step 416, the routine determines a base air amount based on the base fuel amount and a desired air-fuel ratio of the exhaust gas mixture. For example, if the desired exhaust air-fuel ratio is stoichiometry, the routine calculates the base air amount as the stoichiometric proportion of the base fuel amount.

Then, in step 418, the routine determines an excess air amount for the lean cylinders and an excess fuel amount for the rich cylinders based on a desired mixture air-fuel ratio. For example, when the split air-fuel operation is used to control catalyst temperature in feedback fashion, the excess air and excess fuel amounts are determined based on a difference between a desired catalyst temperature and a measured (or estimated) catalyst temperature. As the difference between a desired and measured/estimated catalyst temperature increases, the respective amounts of excess air and excess fuel are increased.

Alternatively, as the measured/estimated catalyst temperature approaches or becomes greater than the desired catalyst temperature, the respective amounts of excess air and excess fuel are decreased. In this way, catalyst temperature can be controlled to the desired catalyst temperature. Also, there are various ways to provide the excess fuel and excess air amounts to the respective cylinder groups.

In one particular example, the excess fuel to the rich cylinder groups is added via the fuel injectors in addition to and at the same time as the base fuel amount. Similarly, the excess air is added to the lean cylinder groups by adjusting the variable cam timing actuator coupled to the lean cylinders (e.g., fuel injected into the rich group is larger than fuel injected into the lean cylinder group, and air entering the rich cylinder group is less than air entering the lean cylinder group).

Alternatively, in place of variable cam timing, one can use variable valve lift, electronically powered valve actuators, and various other valve actuators. In this way, the excess air added to the lean cylinder groups as well as the excess fuel added to the rich cylinder groups does not produce a significant torque imbalance between the lean and rich cylinder groups.

Alternatively, if the cam timing and valve lift of both the cylinder groups is not independently controlled (i.e., fixed cam and valve actuators are in place for all the cylinders), then excess air will be added to both cylinder groups via opening of the throttle.

In this particular case, some of the excess fuel added to the rich cylinder groups may burn and produce a torque imbalance compared to the lean cylinder groups. To counteract this increase in engine torque, the ignition timing of the rich cylinder group is retarded during the split air-fuel operation.

Similarly, even when using the variable cam timing/lift approach described above herein, there may be a slight increase in engine torque on the rich (or lean) cylinder groups. The slight increase can also be compensated for by retarding ignition timing slightly on the cylinder groups operating with a higher torque.

Continuing with FIG. 4, in step 420 the routine adjusts the excess fuel amount to oscillate the mixture air-fuel ratio of the exhaust gas about the desired mixture air-fuel ratio. In one example, a forced modulation can be added to the rich cylinder group fuel injection signal so that the rich air-fuel mixture oscillates between a first rich air fuel ratio and a second richer air-fuel ratio. Further, the oscillation amplitude and frequency can be adjusted based on engine operating conditions such as, for example, engine, speed, engine air flow, catalyst temperature, vehicle speed, and various others.

Alternatively, or in addition to this forced modulation, the excess fuel amount can be adjusted based on feedback from a downstream air-fuel ratio sensor as described above herein with particular reference to FIG. 3. In this way, the mixture air-fuel ratio can oscillate around a desired (for example, stoichiometric) air-fuel ratio by taking into account conditions in or downstream of the catalyst.

When the answer to step 414 is no, the routine continues to step 422. In step 422, the routine determines an air amount based on, for example, a desired air-fuel ratio and feedback from exhaust gas sensors positioned in the exhaust gas. The routine can provide this air amount to the engine by adjusting either or both of the throttle or intake/exhaust valves of the cylinder.

One example of controlling the intake/exhaust valves of the cylinder is to use a variable cam timing system as described above herein. However, the inventors herein recognize various other methods for controlling the intake/exhaust valve such as, for example, variable valve lift, electronically actuated valve opening, and various others.

Then, in step 424, the routine adjusts the fuel injection (or air mount) to also control air-fuel ratio to the desired air-fuel ratio. If desired, further adjustments can be provided based on feedback from exhaust gas sensors coupled in the exhaust system.

Figure 5A:
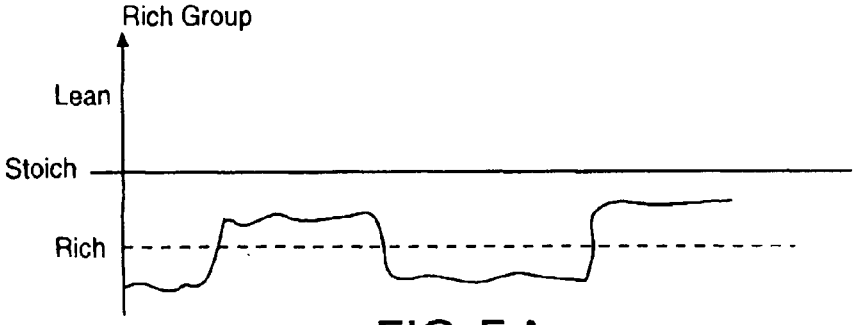
FIGS. 5A–5C are graphs depicting results using the present invention.
Figure 5B:
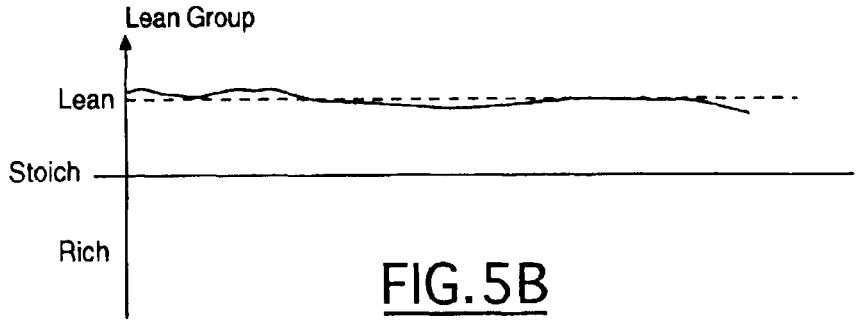
Figure 5C:
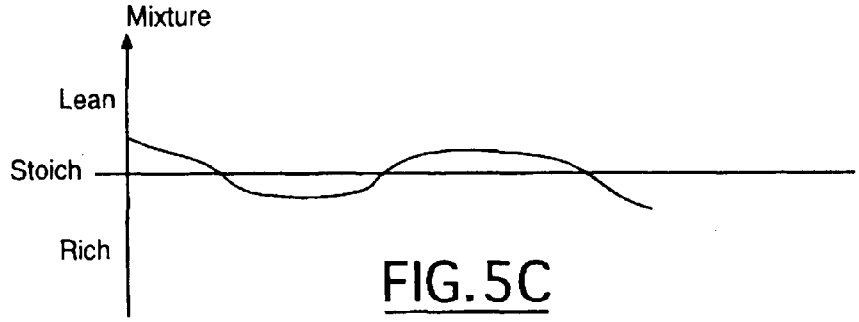

Referring now to FIG. 5 (and in particular FIGS. 5A, 5B, and 5C), various responses of the system including the present invention are shown. FIG. 5A shows the desired (dashed) cylinder group air-fuel ratio for the rich cylinder group as well as the actual rich cylinder group air-fuel ratio (solid line). FIG. 5B shows the desired and actual air-fuel ratio of the lean cylinder group. Finally, FIG. 5C shows the air-fuel ratio of the mixture air-fuel ratio (where the mixture is a mixture of the first and second cylinder groups) entering the downstream emission control device 72. This Figure shows how the present invention changes the rich air-fuel ratio of the rich cylinder group between a first rich value and a second less rich value to oscillate the mixture of the exhaust gases about stoichiometry.

The inventors herein have thus recognized that it is prudent to take into account at least either the conditions in or downstream of the catalyst to effectively control the engine to maximize the removal of contaminants during catalyst regeneration.

Figure 6:
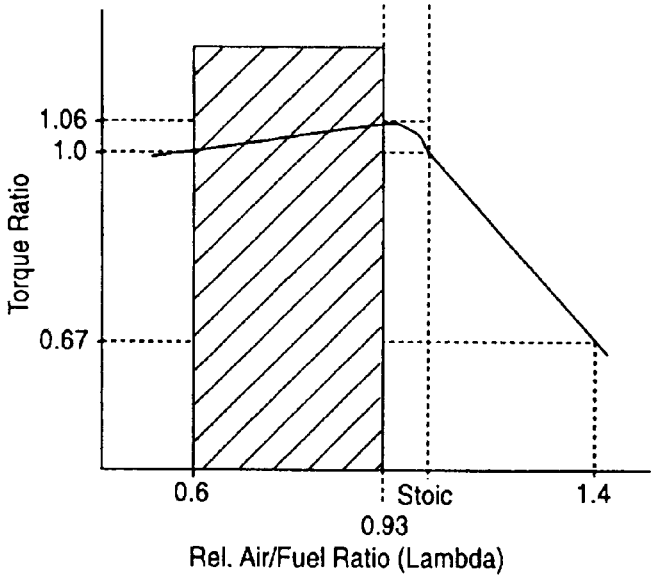
FIG. 6 shows a graph for a typical engine how relative torque varies according to relative air-fuel ratio.

Referring now to FIG. 6, a graph showing engine torque ratio versus combustion air-fuel ratio is shown. The graph illustrates how engine torque changes for a given fuel charge as the cylinder air charge varies. In other words, when the engine operates with a air-fuel ratio greater than one, the engine is combusting a lean air fuel mixture and torque decreases since less fuel is burning to produce combustion heat and pressure.

Alternatively, as the engine operates with an air to fuel ratio less than one, fuel in addition to the stoichiometric ratio is injected. This excess fuel has a slight effect on engine torque due to charge cooling effects. However, as shown in the Figure, variations in supplied fuel when operating rich have a much smaller effect on engine torque than does variations in fuel injected during lean combustion, given that a cylinder air amount is fixed. Thus, this Figure illustrates a principal advantage of the present invention. In particular, the variations in injected fuel to the rich cylinder group provide the oscillating mixture air-fuel ratio, while providing a much smaller effect on engine torque than compared to a system that oscillates both lean and rich cylinder air fuel ratios.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. For example, modulation of the mixture air-fuel ratio provided by adjusting the fuel injected to the rich cylinder group can be provided in various ways (the oscillations can be between various air-fuel ratios, can be of an unequal duty cycle, can have a varying amplitude, etc.).

What is claimed is:

1. A method for controlling an engine having a first and second group of cylinders, both of which are coupled to an emission control device, the method comprising:

operating the first group on average at a first lean air-fuel ratio;

operating the second group at a second air-fuel ratio wherein said second air-fuel ratio is adjusted between a first rich air-fuel ratio and a second, less rich, rich air-fuel ratio; and adjusting said second air-fuel ratio to a larger extent than adjusting said first air-fuel ratio based on a condition in or downstream of the emission control device by controlling at least fuel injected into the second group to cause a mixture air-fuel ratio of a mixture of gasses from the first and second group to oscillate around a predetermined air-fuel ratio.

2. The method recited in claim 1, wherein said condition is based on a sensor coupled to the emission control device.

3. The method recited in claim 1, wherein said condition is based on a sensor coupled to the emission control device.

4. The method recited in claim 1, wherein said modulation is commenced in response to the emission control device reaching a predetermined temperature.

5. The method recited in claim 2, wherein said sensor is a linear-type UEGO sensor and said adjusting is forced modulation.

6. The method recited in claim 1, further comprising limiting said second air-fuel ratio to be richer than a preselected air-fuel ratio.

7. The method recited in claim 1, further comprising limiting said second air-fuel ratio to be richer than or substantially at stoichiometry.

8. The method recited in claim 1, wherein said condition is a mixture composition of exhaust gas downstream of the emission control device.

9. The method recited in claim 1, wherein said condition is a mixture composition of exhaust gas in the emission control device.

10. The method recited in claim 9, wherein said mixture composition of exhaust gas in the emission control device is estimated based on sensors upstream and downstream of the emission control device and further based on an engine operating condition.

11. A method for controlling an engine having a first and second group of cylinders, both of which are coupled to an emission control device, the method comprising:

operating the first group on average at a first lean air-fuel ratio;

operating the second group at a second air-fuel ratio wherein said second air-fuel ratio is adjusted between a first rich air-fuel ratio and a second, less rich, rich air-fuel ratio; and adjusting said second air-fuel ratio based on a condition in or downstream of the emission control device by controlling fuel injected into the second group to cause a mixture air-fuel ratio of a mixture of gasses from the first and second group to oscillate around a predetermined air-fuel ratio, wherein said adjusting of said second air-fuel ratio is based on a determination of both said condition and a sensor coupled upstream of the emission control device and coupled to an exhaust manifold of the engine.

12. A method for controlling an engine having a first and second group of cylinders, both of which are coupled to an emission control device, the method comprising:

indicating emission control device temperature has reached a predetermined temperature; and in response to said indication:

operating the first group on average at a first lean air-fuel ratio;

operating the second group at a second rich air-fuel ratio wherein said second air-fuel ratio is adjusted between a first rich air-fuel ratio and a second, less rich, rich air-fuel ratio; and adjusting said second air-fuel ratio to a larger extent than adjusting said first air-fuel ratio based on an exhaust gas sensor coupled downstream of the emission control device by controlling at least fuel injected into the second group to cause a mixture air-fuel ratio of a mixture of gasses from the first and second group to oscillate around a predetermined air-fuel ratio to thereby efficiently remove sulfur compounds from the emission control device.

13. A method for controlling an engine having a first and second group of cylinders, both of which are coupled to an emission control device, the method comprising:

operating the first group on average at a first lean air-fuel ratio;

operating the second group at a second air-fuel ratio;

adjusting only said second air-fuel ratio to purposely cause a mixture air-fuel ratio of a mixture of gasses from the first and second group to purposely oscillate around a predetermined air-fuel ratio, said adjustment of said second air-fuel ratio being based on a condition in or downstream of the emission control device that is based on information from an air-fuel ratio sensor coupled downstream of the emission control device; and adjusting both said first and second air-fuel ratio by adjusting either injected fuel or engine airflow so that engine output approaches a desired engine output.

14. A method for controlling an engine having a first and second group of cylinders, both of which are coupled to an emission control device, the method comprising:

operating the first group at a first lean air-fuel ratio;

operating the second group at a second rich air-fuel ratio wherein said second air-fuel ratio is adjusted between a first rich air-fuel ratio and a second, less rich, rich air-fuel ratio; and adjusting fuel injected into the first and second group of cylinders based on a condition in or downstream of the emission control device to cause a mixture air-fuel ratio of a mixture of gasses from the first and second group to oscillate around a predetermined air-fuel ratio, said fuel injected into said first group being adjusted based on said condition differently than said fuel injected into said second group.

15. A method for controlling an engine having a first and second group of cylinders, both of which are coupled to an emission control device, the method comprising:

operating the first group on average at a first lean air-fuel ratio;

operating the second group at a second rich air-fuel ratio; and during a predetermined interval, adjuisting only said second rich air-fuel ratio based on a condition in or downstream of the emission control device by controlling fuel injected into the second group to cause a mixture air-fuel ratio of a mixture of gasses from the first and second group to oscillate around a predetermined air-fuel ratio.

16. The method recited in claim 15 wherein said predetermined interval is a desulfurization interval.

17. The method recited in claim 15 wherein said predetermined air-fuel ratio is stoichiometric.

18. A method for controlling an engine having a first and second group of cylinders, both of which are coupled to an emission control device, the method comprising:

indicating emission control device temperature has reached a predetermined temperature; and in response to said indication;

operating the first group on average at a first lean air-fuel ratio;

operating the second group at a second rich air-fuel ratio wherein said second air-fuel ratio is adjusted between a first rich air-fuel ratio and a second, less rich, rich air-fuel ratio; and adjusting said second air-fuel ratio based on a condition in or downstream of the emission control device by controlling at least fuel injected into the second group to purposely cause a mixture air-fuel ratio of a mixture of gasses from the first and second group entering the emission control device to purposely oscillate between a lean air-fuel ratio and a rich air-fuel ratio.

19. A method for controlling an engine having a first and second group of cylinders, both of which are coupled to an emission control device, the method comprising:

operating the first group on average at a first lean air-fuel ratio;

operating the second group at a second air-fuel ratio wherein said second air-fuel ratio is adjusted between a first rich air-fuel ratio and a second, less rich, rich air-fuel ratio; and adjusting said second air-fuel ratio based on a condition downstream of the emission control device by controlling at least fuel injected into the second group to purposely cause an entering mixture air-fuel ratio of a mixture of gasses from the first and second group entering the emission control device to purposely oscillate between a lean air-fuel ratio and a rich air-fuel ratio, said condition downstream of the emission control device including whether an exiting mixture air-fuel ratio of said mixture of gasses exiting the emission control device is leaner than a predetermined lean air-fuel ratio or richer than a predetermined rich air-fuel ratio.

20. A method for controlling an engine having a first and second group of cylinders, both of which are coupled to an emission control device, the method comprising:

operating the first group on average at a first lean air-fuel ratio;

operating the second group at a second air-fuel ratio; and adjusting said second air-fuel ratio to a larger extent than adjusting said first air-fuel ratio based on a condition downstream of the emission control device by controlling at least fuel injected into the second group to purposely cause an entering mixture air-fuel ratio of a mixture of gasses from the first and second group entering the emission control device to purposely oscillate between a lean air-fuel ratio and a rich air-fuel ratio, said condition downstream of the emission control device including whether an exiting mixture air-fuel ratio of said mixture of gasses exiting the emission control device is leaner than predetermined lean air-fuel ratio or richer than a predetermined rich air-fuel ratio.

21. A method for controlling an engine having a first and second group of cylinders, both of which are coupled to an emission control device, the method comprising:

operating the first group on average at a first lean air-fuel ratio;

operating the second group at a second air-fuel ratio wherein said second air-fuel ratio is adjusted between a first rich air-fuel ratio and a second, less rich, rich air-fuel ratio; and adjusting said second air-fuel ratio to a larger extent than adjusting said first air-fuel ratio based on a condition downstream of the emission control device by controlling at least fuel injected into the second group to purposely cause an entering mixture air-fuel ratio of a mixture of gasses from the first and second group entering the emission control device to purposely oscillate between a lean air-fuel ratio and a rich air-fuel ratio.

22. The system recited in claim 1, wherein said modifying of said first rich air-fuel ratio further comprises modifying said first rich air-fuel ratio to a larger extant than said second lean air-fuel ratio, with said modifying based on said downstream sensor.

23. The method recited in claim 11 wherein said sensor is an air-fuel ratio sensor.

24. A method for controlling an engine having a first and second group of cylinders, both of which are coupled to an emission control device, the method comprising:

operating the first group on average at a first lean air-fuel ratio;

operating the second group at a second air-fuel ratio wherein said second air-fuel ratio is adjusted between a first rich air-fuel ratio and a second, less rich, rich air-fuel ratio; and adjusting said second air-fuel ratio based on a condition in or downstream of the emission control device by controlling fuel injected into the second group to cause a mixture air-fuel ratio of a mixture of gasses from the first and second group to oscillate around a predetermined air-fuel ratio, wherein said adjusting of said second air-fuel ratio is based on a determination of both said condition and a sensor coupled upstream of the emission control device and coupled to an exhaust manifold of the engine, said sensor measuring exhaust gasses only from said second groups.

25. A system, comprising:

an engine having a first group of cylinders and a second group of cylinders;

an emission control device coupled to the first group and to the second group;

a first air-fuel ratio sensor coupled upstream of said emission control device that measures exhaust gas only from said first and second cylinder groups;

a second air-fuel ratio sensor coupled downstream of said emission control device;

a controller for operating the first group on average at a first lean air-fuel ratio, operating the second group at a second rich air-fuel ratio wherein said second air-fuel ratio is adjusted between a first rich air-fuel ratio and a second, less rich, rich air-fuel ratio, and adjusting at least one of said first and second air-fuel ratios of at least one of said first and second cylinder groups based on said second air-fuel ratio sensor by controlling fuel injected into said cylinder group to cause a mixture air-fuel ratio of a mixture of gasses from the first and second group to oscillate around a predetermined air-fuel ratio, wherein said controller further adjusts, based on said first air-fuel ratio sensor, fuel injected into said at least one cylinder group whose exhaust gas is measured by said first air-fuel ratio only.

* * * * *